US009926893B2

(12) United States Patent
Hashimoto

(10) Patent No.: US 9,926,893 B2
(45) Date of Patent: Mar. 27, 2018

(54) EXHAUST GAS RECIRCULATION DEVICE

(71) Applicant: DENSO CORPORATION, Kariya, Aichi-pref. (JP)

(72) Inventor: Koji Hashimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/068,747

(22) Filed: Mar. 14, 2016

(65) Prior Publication Data

US 2016/0281651 A1 Sep. 29, 2016

(30) Foreign Application Priority Data

Mar. 23, 2015 (JP) ..... 2015-60192

(51) Int. Cl.

| | |
|---|---|
| ***F02D 9/10*** | (2006.01) |
| ***F02M 35/10*** | (2006.01) |
| ***F02M 26/41*** | (2016.01) |
| ***F02M 26/21*** | (2016.01) |
| ***F02M 26/70*** | (2016.01) |
| ***F02M 26/51*** | (2016.01) |

(52) U.S. Cl.

CPC ..... *F02M 26/41* (2016.02); *F02M 26/21* (2016.02); *F02M 26/51* (2016.02); *F02M 26/70* (2016.02)

(58) Field of Classification Search

CPC ..... F02D 41/0002; F02D 13/0261; F02D 41/0047; F02M 26/10; F02M 26/70; F02M 2026/001; F02M 26/21; F02M 26/41; F02M 23/006

See application file for complete search history.

(56) References Cited

U.S. PATENT DOCUMENTS 4,270,500 A * 6/1981 Nakagawa ..... F01L 3/06 123/308
6,076,499 A * 6/2000 Klumpp ..... F02D 9/101 123/306
6,138,651 A * 10/2000 Mori ..... F02M 26/19 123/568.17
7,263,983 B2 * 9/2007 Maeda ..... F02M 26/48 123/568.21
7,406,823 B2 * 8/2008 Takahashi ..... F01N 3/0231 123/337
7,789,066 B2 * 9/2010 Torii ..... F16K 1/2042 123/336
8,181,633 B2 * 5/2012 Ito ..... F02B 31/06 123/568.17

(Continued)

FOREIGN PATENT DOCUMENTS

JP 2014-236050 A 12/2014

*Primary Examiner* — Long T Tran

(57) ABSTRACT

An exhaust gas recirculation device includes a housing including an inner wall defining an intake passage through which an intake air passes. The housing includes an outlet opening of an EGR gas provided in the inner wall, and a throttle valve positioned in the intake passage and generating a negative pressure at the outlet opening. The housing includes an intake air guide device provided in the housing and guiding the intake air, which has passed between the throttle valve and the inner wall of the housing, toward an axial center area of the intake passage. At least a part of the intake air guide device is positioned on an upstream side of the intake air with respect to the outlet opening.

13 Claims, 4 Drawing Sheets

(56) References Cited

U.S. PATENT DOCUMENTS

| | | | | |
|---|---|---|---|---|
| 8,406,823 | B2 * | 3/2013 | Kondo | H02J 7/025 307/104 |
| 2009/0293838 | A1 * | 12/2009 | Konakawa | F02B 31/06 123/306 |
| 2011/0023846 | A1 * | 2/2011 | Miyazaki | F02M 26/05 123/568.16 |
| 2013/0104859 | A1 * | 5/2013 | Miyazaki | F02D 41/0077 123/568.21 |
| 2015/0322867 | A1 * | 11/2015 | Ito | F02M 35/10262 123/184.21 |

* cited by examiner

EXHAUST GAS RECIRCULATION DEVICE

CROSS REFERENCE TO RELATED APPLICATION

This application is based on and incorporates herein by reference Japanese Patent Application No. 2015-060192 filed on Mar. 23, 2015.

TECHNICAL FIELD

The present disclosure relates to an exhaust gas recirculation device (EGR device) that includes a throttle valve generating a negative pressure at an outlet opening of an EGR gas in an intake passage, at a junction in which the intake passage and an EGR passage join with each other.

BACKGROUND

An EGR device disclosed in Patent Document 1 (JP 2013-096286, US 2013-0104859) is known as an example of the EGR device that includes a throttle valve generating a negative pressure at an outlet opening of an EGR gas. The EGR device disclosed in Patent Document 1 includes an EGR adjustment valve and a throttle valve in a housing defining therein an intake passage and an EGR passage.

The EGR adjustment valve and the throttle valve of the Patent Document 1 are connected with each other, and a valve unit including the EGR adjustment valve and the throttle valve is downsized so as to meet a requirement for a mountability on a vehicle, a mechanical limitation regarding, for example, a link device, and a requirement for a low-cost manufacturing. Therefore, a distance between the throttle valve and an outlet opening of an EGR passage is short. Consequently, when the EGR gas flows into the intake passage through the outlet opening, the throttle valve may be likely exposed to the EGR gas.

If the throttle valve cooled by an intake air is exposed to the EGR gas with a high temperature and containing water vapor (i.e. moisture generated by combustion), the EGR gas is cooled rapidly, and thus the moisture contained the EGR gas easily adheres to the throttle valve as a condensed water.

The condensed water condensed on the throttle valve is sent downstream of the intake air together with a stream of the intake air. However, when an intake-air compressor of a turbocharger is located in the intake passage which is downstream of the intake air with respect to the throttle valve, the condensed water is drawn into the intake-air compressor, and thus the condensed water may collide with a compressor blade. If the collision of the condensed water with the compressor blade is repeated for a long time, the compressor blade may be partially corroded and eroded.

Moreover, even when the intake-air compressor is not located downstream of the intake air with respect to the throttle valve, the condensed water adhering to the throttle valve flows, and thus a packing, which is made of rubber and provided in the intake passage, may be easily deteriorated by the condensed water W. To take an example, the condensed water adhering to the throttle valve may enter a shaft-inserted hole along a shaft driving the throttle valve. The packing that is made of rubber and fills a gap is provided between the housing and the shaft. Therefore, the condensed water contacting the packing for a long time may cause the packing to be deteriorated, and thus an air leakage may occur.

SUMMARY

It is an objective of the present disclosure to provide an EGR device that prevents an EGR gas from flowing to a throttle valve and can avoid troubles due to occurrence of a condensed water on the throttle valve.

According to an aspect of the present disclosure, an exhaust gas recirculation device includes a housing including an inner wall defining an intake passage through which an intake air passes. The housing includes an outlet opening of an EGR gas provided in the inner wall, and a throttle valve positioned in the intake passage and generating a negative pressure at the outlet opening. The housing includes an intake air guide device provided in the housing and guiding the intake air, which has passed between the throttle valve and the inner wall of the housing, toward an axial center area of the intake passage. At least a part of the intake air guide device is positioned on an upstream side of the intake air with respect to the outlet opening. Accordingly, a stream of the intake air guided toward the axial center area of the intake passage by the intake air guide device covers a downstream surface of the throttle valve. Because the downstream surface of the throttle valve is covered with the stream of the intake air, an EGR gas that is high temperature and contains much water vapor is difficult to flow to the throttle valve having been cooled by the intake air, and thus an occurrence of a condensed water on the throttle valve can be limited.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
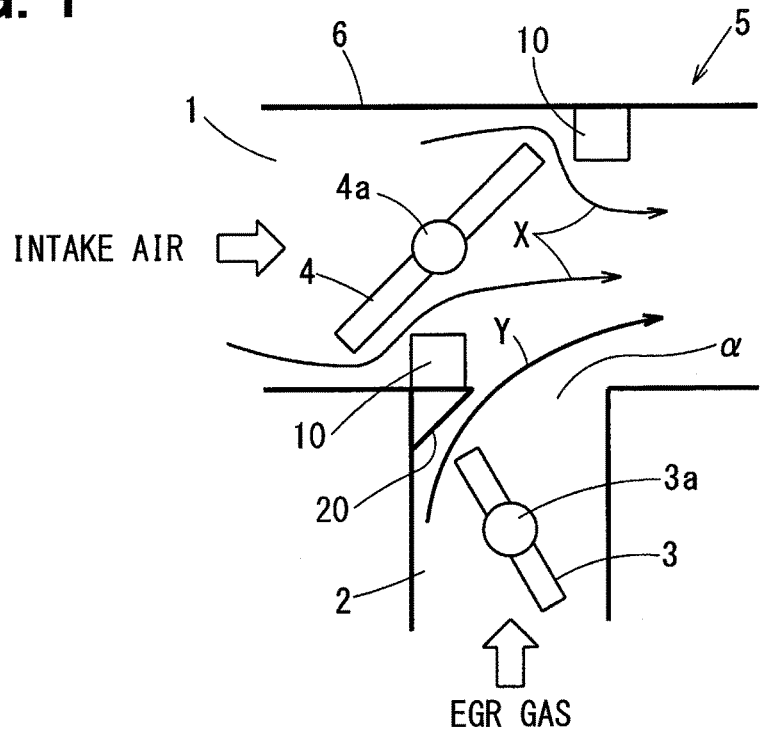
FIG. 1 is a schematic diagram illustrating a valve unit according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Examples (embodiments) of an EGR device of the present disclosure will be described referring to drawings. Embodiments described below are just examples, and it is needless to say that the present disclosure is not limited to the embodiments.

(First Embodiment)

A first embodiment will be described referring to FIG. 1. In the first embodiment, the present disclosure is typically used for a low-pressure EGR device installed in an intake and exhaust gas system of an engine for vehicle traveling.

The low-pressure EGR device is an example of an exhaust gas recirculation device that connects an inside (e.g. a low-pressure area of an exhaust gas) of an exhaust gas passage, which is located downstream of the exhaust gas with respect to a catalyst or a DPF, with an inside (e.g. a low-negative-pressure area of an intake gas) of an intake passage 1. The intake passage 1 is located upstream of the intake air with respect to an intake-air compressor of a turbocharger. The low-pressure EGR device returns a part of the exhaust gas of an engine as an EGR gas to an intake air side of the engine.

The low-pressure EGR device includes an EGR passage 2 for returning a part of the exhaust gas as the EGR gas to the intake passage 1. The EGR passage 2 includes a low-pressure EGR cooler that cools the EGR gas to be returned to the intake air side in addition to an EGR adjustment valve 3 that adjusts a flow rate of the EGR gas by adjusting an opening degree of the EGR passage 2.

The low-pressure EGR device returns the EGR gas in the low-pressure area of the exhaust gas to a low-negative-pressure generation area of the intake gas. Therefore, the low-pressure EGR device is suitable for returning a small amount of the EGR gas to the engine. Even if there is an operating range where a large amount of the EGR gas should be returned to the engine by using the low-pressure EGR device, it is difficult to return a large amount of the EGR gas to the engine by the low-pressure EGR device that is configured to return the EGR gas to the low-negative-pressure generation area of the intake air.

Therefore, the low-pressure EGR device includes a throttle valve (intake throttle valve) 4 generating a negative intake-pressure at an area of the intake passage 1 to which the EGR gas is returned. When the low-pressure EGR device is required to return a large amount of the EGR gas, the throttle valve 4 is controlled to throttle the intake passage 1, and thus introduces a large amount of the EGR gas to the intake passage 1.

The throttle valve 4 generates the negative intake-pressure at a junction in which the intake passage 1 and the EGR passage 2 join with each other. Even when the intake passage 1 is in a state (smallest opening degree) where the intake passage 1 is throttled in maximum by the throttle valve 4, a gap having a predetermined small size between the throttle valve 4 and an inner wall of the housing 6 defining the intake passage 1 is set. Therefore, the gap allows a part of the intake passage 1 to be open. Specifically, the throttle valve 4 is provided so as to open the intake passage 1 at about 10 percent, for example, when the throttle valve 4 is located at a maximum throttle position.

Both the EGR adjustment valve 3 and the throttle valve 4 are provided in a valve unit 5. The valve unit 5 includes: a housing 6 defining a part of the intake passage 1 and a downstream portion of the EGR passage 2; the EGR adjustment valve 3 positioned inside of the EGR passage 2 of the housing 6; the throttle valve 4 positioned inside of the intake passage 1 of the housing 6; an electric actuator for opening and closing the EGR adjustment valve 3; and a link device converting output characteristics of the electric actuator and driving the throttle valve 4.

The housing 6 is made of a metal such as aluminum or resin superior in heat resistance. The inner wall of the housing 6 defines an outlet opening α for the EGR gas which is a downstream end of the EGR passage 2. The EGR adjustment valve 3 is a butterfly valve that rotates in the EGR passage 2 together with a shaft 3*a* rotatably supported by the housing 6. The throttle valve 4 is a butterfly valve that rotates in the intake passage 1 with a shaft 4*a* rotatably supported by the housing 6.

The electric actuator is a known actuator in which an electric motor (for example, DC motor), a gear reducer and a return spring are combined. The electric motor generates a rotation output due to energization. The gear reducer reduces a rotation speed of the electric motor and amplifies an output torque. The return spring urges the EGR adjustment valve 3 through the shaft 3*a* so as to close the EGR adjustment valve 3. The link device includes a characteristics conversion portion (for example, cam groove) that converts the output characteristics of the electric actuator and transmits to the throttle valve 4. When an opening degree of the EGR adjustment valve (low-pressure EGR adjustment valve) 3 is higher than a predetermined degree, the link device reduces an opening degree of the throttle valve 4 in accordance with increase of the opening degree of the EGR adjustment valve 3.

The valve unit 5 includes a return spring included in the electric actuator and a return spring returning the EGR adjustment valve 3 to a fully closing position at which the EGR passage 2 is fully closed. The valve unit 5 includes a stopper device that causes the throttle valve 4 to be stopped at the maximum opening position. Therefore, when the electric actuator (electric motor) is not energized, the EGR adjustment valve 3 is returned to the position where the EGR passage 2 is fully closed, and the throttle valve 4 is returned to a position where the intake passage 1 is fully opened.

Figure 6A:
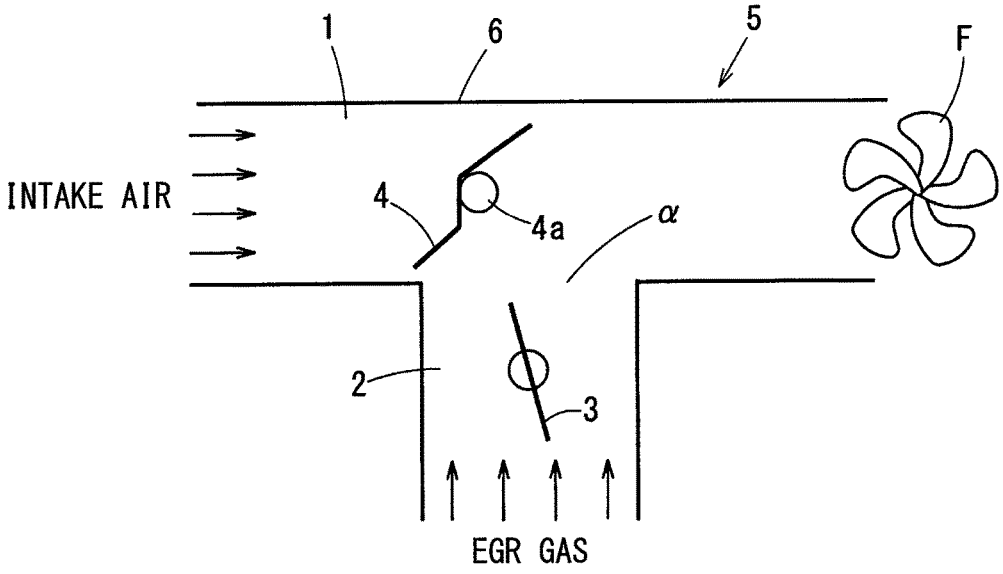
FIG. 6A is a schematic diagram illustrating a valve unit according to a comparative example of the present disclosure.

The valve unit 5 is downsized so as to meet requirement for a mountability on a vehicle, a mechanical limitation regarding the link device or the like, and a requirement for a low-cost manufacturing. Specifically, as shown in FIG. 1, the throttle valve 4 is adjacent to the outlet opening α, and a distance between the throttle valve 4 and the outlet opening α of the EGR passage 2 is short. Consequently, in a comparative example shown in FIGS. 6A and 6B, when the EGR gas flows into the intake passage 1 from the EGR passage 2 through the outlet opening α, the EGR gas likely flows to and contacts the throttle valve 4.

Because the intake passage 1 introduces air (fresh air) from an atmosphere to an engine, the throttle valve 4 is cooled by the intake air (fresh air). The EGR gas is an exhaust gas that is high temperature and contains water vapor generated by combustion. Therefore, when the high temperature EGR gas containing water vapor flows to the throttle valve 4 that has been cooled by the intake air, the EGR gas flowing to the throttle valve 4 is cooled rapidly, and thus the water vapor contained in the EGR gas adheres to the throttle valve 4 as a condensed water W.

Figure 6B:
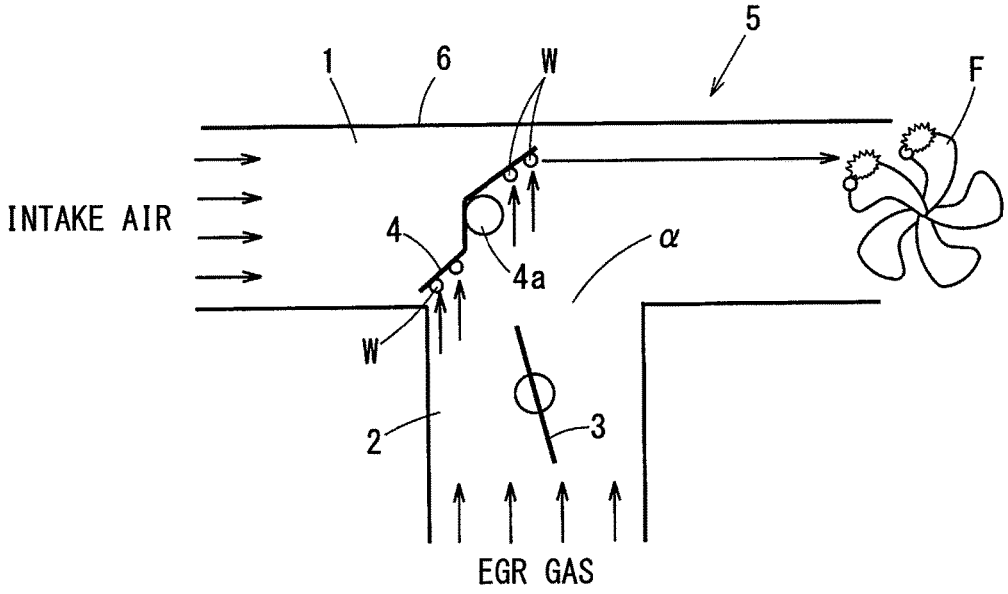
FIG. 6B is a schematic diagram illustrating the valve unit according to the comparative example.

When the condensed water W that has adhered to the throttle valve 4 and has grown is sent to a downstream side of the intake air together with a stream of the intake air and is drawn in an intake-air compressor, the condensed water may contact and collide with a compressor blade F. Accordingly, if the compressor blade F is used for a long time, the compressor blade F may be partially corroded and eroded, as shown in FIG. 6B.

Moreover, even when the intake-air compressor is not located downstream of the intake air with respect to the throttle valve 4, the condensed water W adhering to the throttle valve 4 flows, and thus a packing, which is made of rubber and provided in the intake passage 1, may be easily deteriorated by the condensed water W. To take an example, the condensed water W adhering to the throttle valve 4 may enter a shaft-inserted hole along a shaft 4*a* driving the throttle valve 4. The packing that is made of rubber and fills a gap is provided between the housing 6 and the shaft 4*a*. Therefore, the condensed water W contacting the packing for a long time may cause the packing to be deteriorated, and thus an air leakage may occur.

In contrast, in the first embodiment, an intake air guide device (intake air deflection device) 10 is provided in the housing 6 so that a part of the intake air guide device 10 is located on an upstream side of the intake air with respect to the outlet opening α. The intake air guide device 10 has an annular shape extending along an inner peripheral wall of the housing 6 defining the intake passage 1. The intake air guide device 10 guides (deflects) the intake air, which has passed between the throttle valve 4 and the inner wall of the housing 6, toward an axial center area of the intake passage 1. At least a part of the intake air guide device 10 is positioned on an inner wall of the housing 6 that is on the upstream side of the intake air with respect to the outlet opening α and on a downstream side of the intake air with respect to the throttle valve 4. Whole of the intake air guide device 10 may be on the upstream side of the intake air with respect to the outlet opening α and on the downstream side of the intake air with respect to the throttle valve 4. The intake air guide device 10 guides the intake air that has passed the throttle valve 4 toward the axial center area of the intake passage 1. The intake air guide device 10 is a protrusion portion protruding toward the axial center area of the intake passage 1 from an inner wall surface of a part of the housing 6 that defines the intake passage 1. When the intake passage 1 is viewed from the upstream side of the intake air, the intake air guide device 10 is provided at least within an area in which the outlet opening α positioned.

Specifically, the intake air guide device 10 of the present embodiment has an annular shape along an inner peripheral wall of the housing 6 defining the intake passage 1, for example. All of the intake air that has passed between the throttle valve 4 and the inner wall of the housing 6 is guided toward the axial center area of the intake passage 1.

The intake air guide device 10 may be attached to the housing 6 after being separately formed from the housing 6. The housing 6 and the intake air guide device 10 of the present embodiment may be provided as a single component. A shape of a cross-section of the intake air guide device 10 is not limited as long as the intake air guide device 10 can change a flow the intake air flowing along the inner wall of the housing 6 toward the axial center area of the intake passage 1. To take an example for helping understanding, the shape of the cross-section of the intake air guide device 10 of the present embodiment is made rectangle as an example, as shown in FIG. 1.

(Effect 1 of First Embodiment)

The low-pressure EGR device includes the intake air guide device 10 on the inner wall surface of the housing 6. A part of the intake air guide device 10 is adjacent to the outlet opening α between on the upstream side of the intake air with respect to the outlet opening α and on the downstream side of the intake air with respect to the throttle valve 4. The intake air guide device 10 guides the intake air, which has passed an area around the throttle valve 4, toward the axial center area of the intake passage 1. The intake air passing between the throttle valve 4 and the inner wall of the housing 6 is guided toward the axial center area of the intake passage 1 by the intake air guide device 10, as shown by arrows X in FIG. 1. Consequently, the intake air turns toward a downstream surface of the throttle valve 4 that is a surface of the throttle valve 4 on the downstream side of the intake air, and the downstream surface is covered with the intake air. Accordingly, an EGR gas flowing into the intake passage 1 through the outlet opening α becomes unlikely to contact the throttle valve 4, as shown by an arrow Y in FIG. 1. The EGR gas becomes not to flow in a stagnation portion generated on the downstream side of the intake air with respect to the throttle valve 4, and the EGR gas becomes unlikely to contact the throttle valve 4.

Because the EGR gas having a high temperature and containing much water vapor becomes unlikely to contact the throttle valve 4 cooled by the intake air, a generation of a condensed water on the throttle valve 4 can be limited. Accordingly, a collision of the condensed water with the compressor blade F after the condensed water is drawn in the intake-air compressor can be limited. Therefore, even when the compressor blade F is used for a long time, corrosion and erosion of the compressor blade F caused by the condensed water can be avoided, and thus a long-term reliability of a turbocharger can be higher (regarding reference numerals, refer to FIG. 6).

Moreover, because the generation of the condensed water on the throttle valve 4 can be limited, a deterioration of the packing, which is made of rubber and provided in the intake passage 1, caused by a contact of the condensed water flowing from the throttle valve 4 can be limited. Specifically, an entry of the condensed water to the shaft-inserted hole through the shaft 4*a* of the throttle valve 4 can be limited. Accordingly, a deterioration of the packing, which is made of rubber and sealing a gap between the shaft 4*a* of the throttle valve 4 and the housing 6, due to the contact of the condensed water for a long time can be limited, and thus an air leakage accompanied by the deterioration of the packing can be limited. Therefore, a long-term reliability of the low-pressure EGR device including the valve unit 5 can be higher.

Effect 2 of First Embodiment)

As described above, the intake air guide device 10 of the first embodiment has an annular shape along the inner peripheral wall of the housing 6. Accordingly, a stream of the intake air that has passed between the throttle valve 4 and the inner wall of housing 6 can be gathered around a center area of the downstream surface of the throttle valve 4. The stream of the intake air may be gathered in such a way as an opening of a drawstring bag to be closed. Thus, a route through which the EGR gas approaches the downstream surface of the throttle valve 4 can be blocked off, and it becomes to be difficult for the EGR gas to flow to and to contact the throttle valve 4. The annular shape of the intake air guide device 10 along the inner peripheral wall of the housing 6 can cause the EGR gas to flow separately from the throttle valve 4, and thus the generation of the condensed water on the throttle valve 4 can be limited more effectively.

(Effect 3 of First Embodiment)

The housing 6 of the first embodiment includes a gas guide device (gas deflection device) 20 guiding (deflecting), to a downstream direction of the intake air, the EGR gas flowing into the intake passage 1 from the EGR passage 2 through the outlet opening α. The gas guide device 20 is located on an upstream side of the outlet opening α and has a protrusion shape protruding from the upstream side toward downstream of the intake air. The gas guide device 20 may be attached to the housing 6 after being separately formed from the housing 6. The housing 6 and the gas guide device 20 of the present embodiment are provided as a single component as with the intake air guide device 10.

The gas guide device 20 positioned on the outlet opening α that is an outlet end of the EGR passage 2 can actively guide, toward the downstream side of the intake air, the stream of the EGR gas flowing into the intake passage 1 through the outlet opening α. Accordingly, the EGR gas becomes unlikely to contact the throttle valve 4, and the generation of the condensed water on the throttle valve 4 can be limited more effectively. In the present embodiment, the intake air guide device 10 and the gas guide device 20 are used. Accordingly, the EGR gas becomes more unlikely to contact the throttle valve 4, and the generation of the condensed water on the throttle valve 4 can be limited more effectively.

Specifically, in the first embodiment, when both the intake air guide device 10 and the gas guide device 20 are used, a temperature of a surface of the throttle valve 4 can be reduced by 45.7° C. compared with a case where neither the intake air guide device 10 nor the gas guide device 20 are used. Because the EGR gas is prevented from flowing to the throttle valve 4, the temperature of the throttle valve 4 decreases. Accordingly, the generation of the condensed water on the throttle valve 4 can be limited.

(Second Embodiment)

Figure 2:
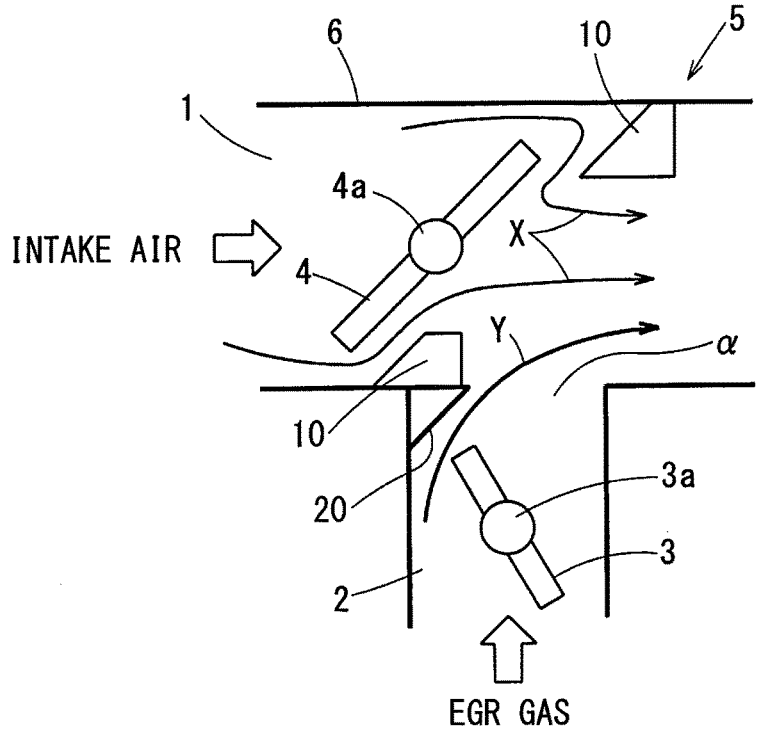
FIG. 2 is a schematic diagram illustrating a valve unit according to a second embodiment of the present disclosure.

A second embodiment will be described referring to FIG. 2. In all embodiments described below, the same reference numerals as the first embodiment represent the same elements having the same function. In the second embodiment, an upstream surface of an intake air guide device 10 is approximately parallel to a surface of a throttle valve 4 when the throttle valve 4 throttles an intake passage 1 in maximum. The upstream surface of the intake air guide device 10 guides an intake air flowing along an inner peripheral wall of the housing 6 defining the intake passage 1.

By providing the upstream surface of the intake air guide device 10 to be tilted with the inner surface of the housing 6, a stream of the intake air that has passed between the throttle valve 4 and an inner wall of the housing 6 can be more effectively guided to a center area of a downstream surface of the throttle valve 4. Accordingly, a contact of the EGR gas with the throttle valve 4 can be limited more certainly, and a generation of a condensed water on the throttle valve 4 can be limited more effectively.

(Third Embodiment)

Figure 3:
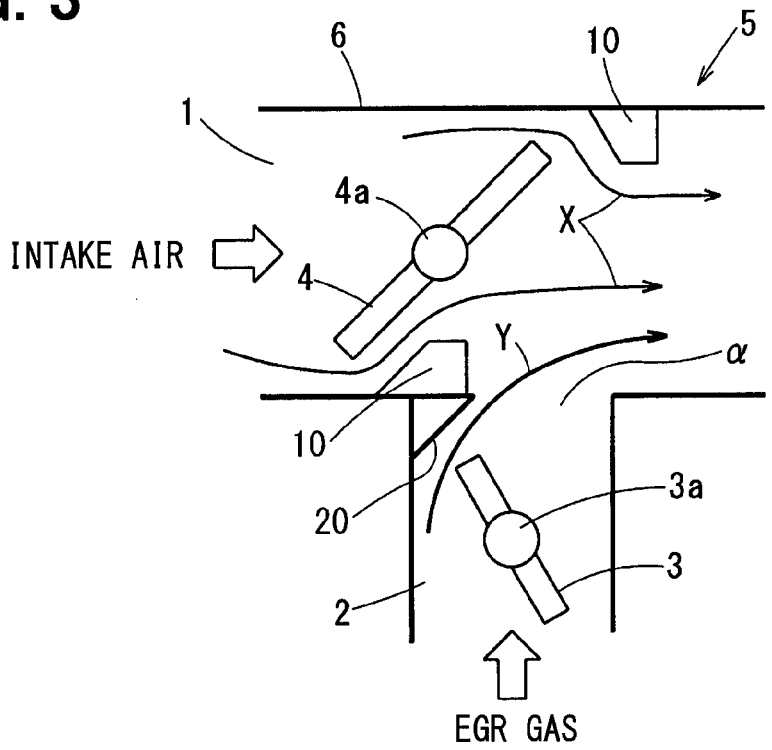
FIG. 3 is a schematic diagram illustrating a valve unit according to a third embodiment of the present disclosure.

A third embodiment will be described referring to FIG. 3. In the third embodiment, an upstream surface of an intake air guide device 10 is sloped toward a downstream direction of an intake air. Such shape of the upstream surface of the intake air guide device 10 can decrease a loss of pressure due to the intake air guide device 10. An EGR device of the third embodiment decrease the loss of pressure of the intake air due to the intake air guide device 10 with securing an effect in preventing an EGR gas from contacting a throttle valve 4.

(Fourth Embodiment)

Figure 4:
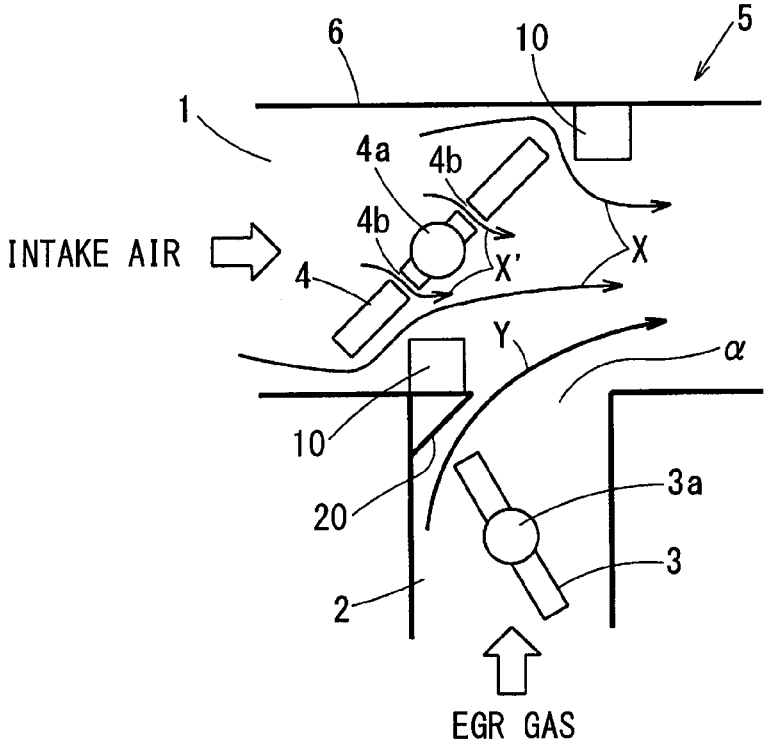
FIG. 4 is a schematic diagram illustrating a valve unit according to a fourth embodiment of the present disclosure.

A fourth embodiment will be described referring to FIG. 4. An EGR device of the fourth embodiment includes one through-hole 4*b* or multiple through-holes 4*b* are provided in a throttle valve 4. The through-hole 4*b* penetrates through a plate member of the throttle valve 4, and communicates an upstream side of an intake air and a downstream side of the intake air with respect to the throttle valve 4 with each other. A stream (refer to arrows X' in FIG. 4) of the intake air passing the through-hole 4*b* functions as a protective stream on a surface on a downstream side of the throttle valve 4, and thus the EGR gas is prevented by the protective stream from flowing to contacting the throttle valve 4. Therefore, a contact of the EGR gas with the throttle valve 4 can be limited more certainly, and a generation of a condensed water on the throttle valve 4 can be limited more effectively.

(Fifth Embodiment)

A fifth embodiment will be described referring to FIG. 5. When an intake passage 1 is viewed from an upstream side or a downstream side of an intake air, an intake air guide device 10 of the fifth embodiment is provided only on a side, on which an outlet opening α is located, instead of whole circumference of the intake passage 1. The intake air guide device 10 may be provided only near the outlet opening α. When the intake passage 1 is viewed from the upstream side or the downstream side of the intake air, the intake air guide device 10 is provided only in an area where the outlet opening α is located or in an area including the area where the outlet opening α is located.

Figure 5:
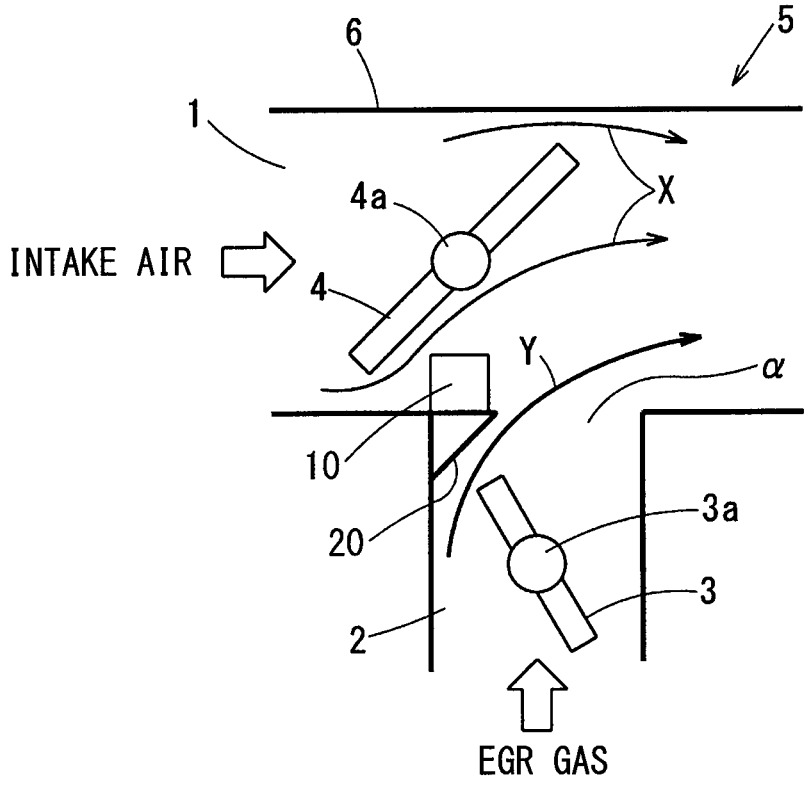
FIG. 5 is a schematic diagram illustrating a valve unit according to a fifth embodiment of the present disclosure.

The intake air guide device 10 having such configuration can provide a protective stream between an EGR gas flowing into the intake passage 1 through the outlet opening α and a downstream surface of a throttle valve 4, as shown by arrows X in FIG. 5. Accordingly, the EGR gas flowing to the throttle valve 4 can be limited, and a generation of a condensed water on the throttle valve 4 can be limited.

Although the present disclosure has been fully described in connection with the preferred embodiments thereof with reference to the accompanying drawings, it is to be noted that various changes and modifications will become apparent to those skilled in the art.

In the above-described embodiments, an example where both the intake air guide device 10 and the gas guide device 20 are provided is shown, but the EGR device is not limited to this configuration. The EGR device may include only the intake air guide device 10. The EGR device may include both the intake air guide device 10 and the through-hole 4*b*.

In the above-described embodiments, an example where the intake-air compressor is disposed on the downstream side of the intake air with respect to the valve unit 5 is shown, but the present disclosure may be adopted to an EGR device that does not include the intake-air compressor on the downstream side of the intake air with respect to the valve unit 5.

Additional advantages and modifications will readily occur to those skilled in the art. The disclosure in its broader terms is therefore not limited to the specific details, representative apparatus, and illustrative examples shown and described.

What is claimed is:

1. An exhaust gas recirculation device comprising:

a housing including an inner wall defining an intake passage through which an intake air passes, and an outlet opening of an EGR gas provided in the inner wall;

a throttle valve positioned in the intake passage and generating a negative pressure at the outlet opening; and an intake air guide device provided in the housing and guiding the intake air, which has passed between the throttle valve and the inner wall of the housing, toward an axial center area of the intake passage, wherein at least a part of the intake air guide device is positioned on an upstream side of the intake air with respect to the outlet opening, the intake air guide device is provided in the intake passage, the inner wall of the housing defines an EGR passage that extends from the outlet opening, the EGR gas flowing through the EGR passage, the housing includes a gas guide device that guides the EGR gas, which flows into the intake passage through the outlet opening, in a downstream direction of the intake air, the gas guide device is located in the EGR passage, and the gas guide device protrudes from an inner wall of the outlet opening of the EGR gas toward an axial center area of the EGR passage.

2. The exhaust gas recirculation device according to claim 1, wherein the intake air guide device is provided adjacent to the outlet opening at least in an area in which the outlet opening positioned.

3. The exhaust gas recirculation device according to claim 1, wherein the intake air guide device is in an annular shape extending along an inner peripheral wall of the housing defining the intake passage.

4. The exhaust gas recirculation device according to claim 1, wherein the throttle valve includes at least one through-hole communicating the upstream side of an intake air with a downstream side of the intake air with respect to the throttle valve with each other.

5. The exhaust gas recirculation device according to claim 1, wherein the intake air guide device is a first protrusion portion that protrudes from the inner wall of the intake passage toward the axial center area of the intake passage.

6. The exhaust gas recirculation device according to claim 1, wherein the intake air guide device has an annular shape extending along the inner wall of the intake passage, the intake air guide device includes a first portion and a second portion, the first portion being located upstream of the second portion with respect to the EGR gas, the second portion being located on an opposite side of the first portion in a radial direction of the intake passage, and the second portion is located downstream of the first portion with respect to the intake air.

7. The exhaust gas recirculation device according to claim 6, wherein the second portion of the intake air guide device is located downstream of an axial center of the outlet opening with respect to the intake air.

8. The exhaust gas recirculation device according to claim 1, wherein an upstream surface of the intake air guide device is inclined with respect to the intake air, and the upstream surface is parallel to a surface of the throttle valve when the throttle valve throttles the intake passage at maximum.

9. The exhaust gas recirculation device according to claim 8, wherein the upstream surface of the intake air guide device is inclined in the downstream direction of the intake air.

10. The exhaust gas recirculation device according to claim 1, wherein the intake air guide device and the gas guide device are integrated with each other.

11. The exhaust gas recirculation device according to claim 1, wherein the EGR passage is branched from the intake passage.

12. An exhaust gas recirculation device comprising:

a housing including an inner wall defining an intake passage through which an intake air passes, and an outlet opening of an EGR gas provided in the inner wall;

a throttle valve positioned in the intake passage and generating a negative pressure at the outlet opening; and an intake air guide device provided in the housing and guiding the intake air, which has passed between the throttle valve and the inner wall of the housing, toward an axial center area of the intake passage, wherein at least a part of the intake air guide device is positioned on an upstream side of the intake air with respect to the outlet opening, the intake air guide device is provided in the intake passage, the intake air guide device has an annular shape extending along the inner wall of the intake passage, the intake air guide device includes a first portion and a second portion, the first portion being located upstream of the second portion with respect to the EGR gas, the second portion being located on an opposite side of the first portion in a radial direction of the intake passage, and the second portion is located downstream of the first portion with respect to the intake air.

13. The exhaust gas recirculation device according to claim 12, wherein the second portion of the intake air guide device is located downstream of an axial center of the outlet opening with respect to the intake air.

* * * * *